US011045021B2

(12) United States Patent
Eggleston et al.

(10) Patent No.: US 11,045,021 B2
(45) Date of Patent: Jun. 29, 2021

(54) SURFACE COLLECTIBLE

(71) Applicant: THE UPPER DECK COMPANY, Carlsbad, CA (US)

(72) Inventors: Michael Eggleston, Carlsbad, CA (US); Grant Sandground, Carlsbad, CA (US)

(73) Assignee: The Upper Deck Company, Carlsbad, CA (US)

( * ) Notice: Subject to any disclaimer, the term of this patent is extended or adjusted under 35 U.S.C. 154(b) by 0 days.

(21) Appl. No.: 16/240,001

(22) Filed: Jan. 4, 2019

(65) Prior Publication Data

US 2019/0208929 A1 Jul. 11, 2019

Related U.S. Application Data

(60) Provisional application No. 62/614,202, filed on Jan. 5, 2018.

(51) Int. Cl.

| | |
|---|---|
| ***G09F 19/00*** | (2006.01) |
| ***A47G 1/12*** | (2006.01) |
| ***G09F 19/22*** | (2006.01) |

(52) U.S. Cl.

CPC ..... *A47G 1/12* (2013.01); *G09F 19/228* (2013.01); *G09F 19/00* (2013.01)

(58) Field of Classification Search

CPC ..... A47G 1/12; G09F 19/00; G09F 19/228

See application file for complete search history.

(56) References Cited

U.S. PATENT DOCUMENTS

| | | | | |
|---|---|---|---|---|
| 5,698,334 A * | 12/1997 | Berens | ..... | G09F 19/00 428/15 |
| 6,220,441 B1 * | 4/2001 | Cook | ..... | A45C 13/08 206/315.1 |
| 6,598,558 B2 * | 7/2003 | Griffin | ..... | G09F 17/00 116/173 |

(Continued)

OTHER PUBLICATIONS

Joe DiMaggio Autographed Photo w/Yankee Stadium Brick and Dirt JSA/Steiner COA. True Autographs, https://www.trueautographs.com/products/joe-dimaggio-autographed-photo-w-yankee-stadium-brick-and-dirt-psa-dna-coa (Retrieved Jun. 22, 2018) (Year: 2018).*

(Continued)

*Primary Examiner* — Cassandra Davis

(74) *Attorney, Agent, or Firm* — Roeder & Broder LLP; James P. Broder

(57) ABSTRACT

A surface collectible (10) includes a surface member (12) and a textile (316) secured to the surface member (12). The surface member (12) is detached from a venue surface (11). The surface member (12) can be event-used. In one embodiment, the surface member (12) can include flooring. The textile (316) can include at least a portion of an article of clothing. The article of clothing can also be event-used. The surface collectible (10) can also include an image (214) imprinted on the surface member (12). The image (214) can include a sporting logo. Alternatively, the image (214) can include at least one of a professional athlete, a non-professional athlete, an athletically-involved person, an entertainer, an actor, a historical figure and a public figure. The surface collectible (10) may further include an autograph (418) inscribed on the surface member (12) and/or on the textile (316).

12 Claims, 4 Drawing Sheets

(56) References Cited

U.S. PATENT DOCUMENTS

| | | | | |
|---|---|---|---|---|
| 6,827,209 | B1 * | 12/2004 | Tank | B42D 15/00 206/232 |
| 7,340,813 | B2 * | 3/2008 | Hampton | A47C 7/24 29/91 |
| 2003/0188468 | A1 * | 10/2003 | Tahan | A47F 7/00 40/538 |
| 2003/0196362 | A1 * | 10/2003 | Harwell | G09F 1/10 40/661 |
| 2004/0159363 | A1 * | 8/2004 | Foil, Jr. | D03D 13/004 139/416 |
| 2009/0121436 | A1 * | 5/2009 | Perkins | B42D 15/027 273/298 |
| 2010/0308701 | A1 * | 12/2010 | Haine | A47G 1/12 312/114 |
| 2017/0150833 | A1 * | 6/2017 | Harmon | A47G 1/12 |

OTHER PUBLICATIONS

Sweetwaterstyle, Fabric Covered Brick Doorstop Tutorial (Posted Jan. 5, 2014) http://sweetwaterstyle.com/2014/01/fabric-covered-brick-doorstop-tutorial/ (retrieved Jun. 22, 2019). (Year: 2014).*

Cool Sports Shadow Boxes (Posted on Jul. 6, 2016) http://www.csdframing.com/2016/07/06/cool-sports-shadowboxes/ (retrieved Jun. 22, 2019) 2004/0159363. (Year: 2016).*

Blowout Cards, Kevin Love autographs (Posted on Dec. 11, 2015) https://www.blowoutcards.com/blog/tag/kevin-love-autographs/ (retrieved Jun. 22, 2019). (Year: 2015).*

2016-17 Upper Deck Supreme Hard Court Autograph Quad Patch Relic Magic Johnson https://www.ebay.com/itm/2016-17-Upper-Deck-Supreme-Hard-Court-Autograph-Quad-Patch-Relic-Magic-Johnson/293123098418?hash=item443f7f8732:g:2ZQAAOSwPqRdBtfb (retrieved Jun. 22, 2019) (Year: 2019).*

Herder, Gudy "A Mood Board Masterclass for Architects and Interior Designers" https://www.eclectictrends.com/mood-board-masterclass-for-architects-and-interior-designers /Nov. 14, 2018. (Year: 2018).*

Behance. "Sample Board III—2010 / 2011." Behance, Aug. 28, 2011, www.behance.net/gallery/2035037/Sample-Board_Pro. (Year: 2011).*

WorthPoint, 2003 Upper Deck Kobe Bryant Authentic Floor And Fabric Relic Combo, (Sold: Sep. 24, 2015), https://www.worthpoint.com/inventory/refineSearch?offset=20&max=20&query=basketball+floor+fabric&category=. (Year: 2015).*

Flickr, Adam Fox, 03-04 Upper Deck Hardcut Floor/Fabric Combo, Taken on Feb. 1, 2012 (Uploaded Sep. 3, 2014). https://www.flickr.com/photos/21054071@N07/15124999702/in/photolist-f4b1W3-EZJei6-f4b1TQ-f4aWUs-frVfzY-f3VMvc-XWYHe7-f4dft5-jprzxA-nkkETL-Ygortu-nkipKe-FRaUXj-JKsPf8-oL21MB-5XotypVRUY (Year: 2014).*

* cited by examiner

SURFACE COLLECTIBLE

RELATED APPLICATION

This application claims priority on U.S. Provisional Application Ser. No. 62/614,202 filed on Jan. 5, 2018 and entitled "HARDWOOD COURT COLLECTIBLE". As far as permitted, the contents of U.S. Provisional Application Ser. No. 62/614,202 are incorporated herein by reference.

BACKGROUND

Sports collectibles or memorabilia generally refers to a souvenir, a memento and/or a keepsake that is directly connected to past, present and future athletes, sports teams and/or sporting events, whether it be professional or non-professional (i.e., semi-professional, collegiate, amateur, etc.). Sports collectibles often include photos, trading cards, autographs, uniforms and/or other related sports equipment.

SUMMARY

The present invention is directed toward a surface collectible. In various embodiments, the surface collectible includes a surface member and a textile secured to the surface member. The surface member can be detached from a venue surface. The surface member can be formed from a material that forms a portion of a sporting venue, an entertainment venue, a historical landmark, or any other suitable location of significance. In certain embodiments, the surface member can have been used during a sporting event, an entertainment event, a historical event, or any other suitable event of significance. In one embodiment, the surface member can include hardwood flooring or flooring from any other sporting event, entertainment event, historical event, or any other event of significance. In alternative embodiments, the surface member can have been taken from any portion of a sporting arena, stadium, rink, court, etc., including portions of walls, floors, gates, ceilings, benches, seats, sporting equipment, or any other instrumentality used in any given sport, entertainment, celebrity or public event. The surface member can be formed from any suitable material, i.e. wood, plastic, plexiglass, glass, metal, composites, etc., as non-exclusive examples.

In certain embodiments, the textile can include at least a portion of an article of clothing. In one embodiment, the article of clothing can include a sports uniform. In certain embodiments, the article of clothing can be event-used. As used herein, the term "event-used" means actually used during a sporting event, entertainment event, historical event, or any other suitable event of significance.

In some embodiments, the surface collectible can also include an image imprinted on the surface member. In one embodiment, the image can include a photograph or artwork. In another embodiment, the image can include a graphic. In still another embodiment, the image can include a digital image. In yet another embodiment, the image can include a computer generated image. In even another embodiment, the image can include a hologram.

In certain embodiments, the image can include a sporting logo. In other embodiments, the image can include at least one of a professional athlete, a non-professional athlete and an athletically-involved person.

Additionally, in various embodiments, the surface collectible can further include an autograph inscribed on the surface member. In alternative embodiments, the autograph can be inscribed on the textile.

The present invention is further directed toward a method for manufacturing a surface collectible. The method includes the steps of removing a surface member from a venue surface and securing a textile to the surface member. In some embodiments, the step of removing can include detaching at least a portion of a hardwood flooring. In other embodiments, the step of securing can include securing at least a portion of a sports uniform to the surface member.

In various embodiments, the method can also include the step of imprinting an image on the surface member. In such embodiments, the step of imprinting can include imprinting at least one of a sporting logo or other trademark or mark, a professional athlete, a non-professional athlete, an entertainer, a celebrity, and an athletically-involved person.

In other embodiments, the method can further include the step of inscribing an autograph on the surface member. In alternative embodiments, the method can include the step of inscribing the autograph on the textile.

In certain applications, the present invention is further directed toward a surface collectible. The surface collectible includes a surface member, a textile secured to the surface member, an image imprinted on the surface member and an autograph inscribed on the surface member. The surface member is event-used and detached from a venue surface.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a surface collectible. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
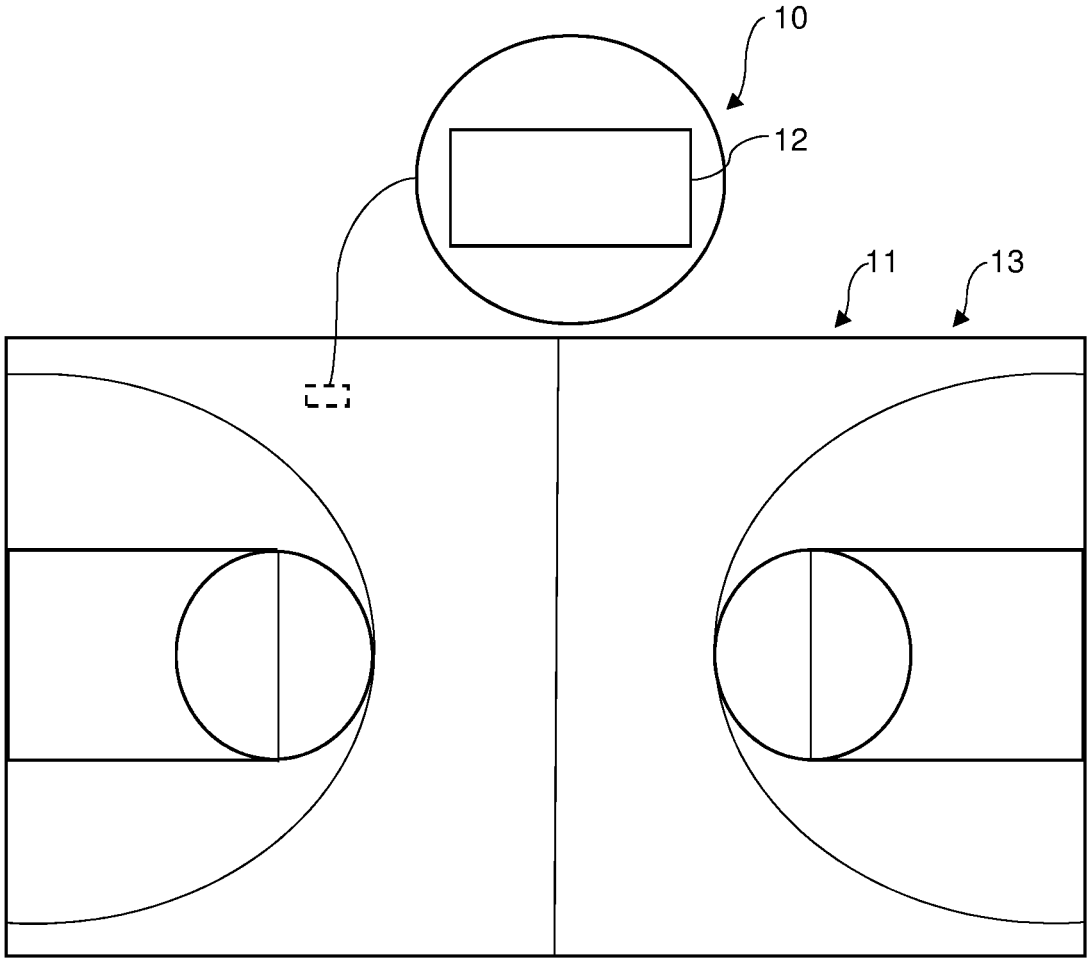
FIG. 1 is a simplified schematic view of a venue and one embodiment of a portion of a surface collectible having features of the present invention.

FIG. 1 is a simplified schematic view of one embodiment of a surface collectible 10. The design, material(s) and/or configuration of the surface collectible 10 can vary. Although the surface collectible 10 in FIG. 1 is specifically shown with respect to the sport of basketball, it is understood and appreciated that other professional sports collectibles, other non-professional sports and entertainment collectibles and/or other collectibles from events other than sporting events can equally benefit by the teachings provided herein. In certain embodiments, such as the embodiment illustrated in FIG. 1, the surface collectible 10 can include one or more of a surface member 12. It is understood that the surface collectible 10 can include additional or different components than those specifically illustrated herein.

In various embodiments, the surface member 12 includes a portion of a venue surface 11 that is detached or removed from the venue surface 11 from a venue 13. As referred to herein, the venue surface 11 can be included in any portion of a sporting venue, an entertainment venue, a historical venue or any other suitable type of venue 13. The surface member 12 can include any suitable type of flooring, walls, ceiling, court, seats, benches, fields and/or surfaces of any professional or non-professional sporting venue, with such sports including, without limitation, basketball, baseball, football, hockey, soccer, tennis, etc. In the embodiment illustrated in FIG. 1, the surface member 12 can include, by way of one non-exclusive example, a portion of the original and/or actual hardwood flooring of a professional basketball team. While FIG. 1 illustrates the hardwood flooring of the professional basketball team, it is understood that the surface member 12 may include a portion of the venue surface 11 of any professional and/or non-professional sports individual or team, or a public/historical figure, entertainer, etc. As referred to herein, the term non-professional may include semi-professional, collegiate and/or amateur sports individuals or teams, or entertainers or celebrities, or public figures. In some embodiments, the surface member 12 can be event-used. As used herein in reference to the surface member 12, "event-used" means that the surface member formed part of or was included in a venue 13 that was actually used at some point for a sporting event, entertainment or celebrity event, historical event, or any other suitable event of any significance. The surface member 12 can be formed from any suitable material, i.e. wood, plastic, plexiglass, glass, metal, composites, etc., as non-exclusive examples.

Further, it is also appreciated that the drawings included herewith are not necessarily drawn to scale. For example, in FIG. 1, the size of the surface member 12 is not necessarily to scale to the size of the venue surface 11 for purposes of clarity in demonstrating certain features and limitations of the surface member 12.

Figure 2:
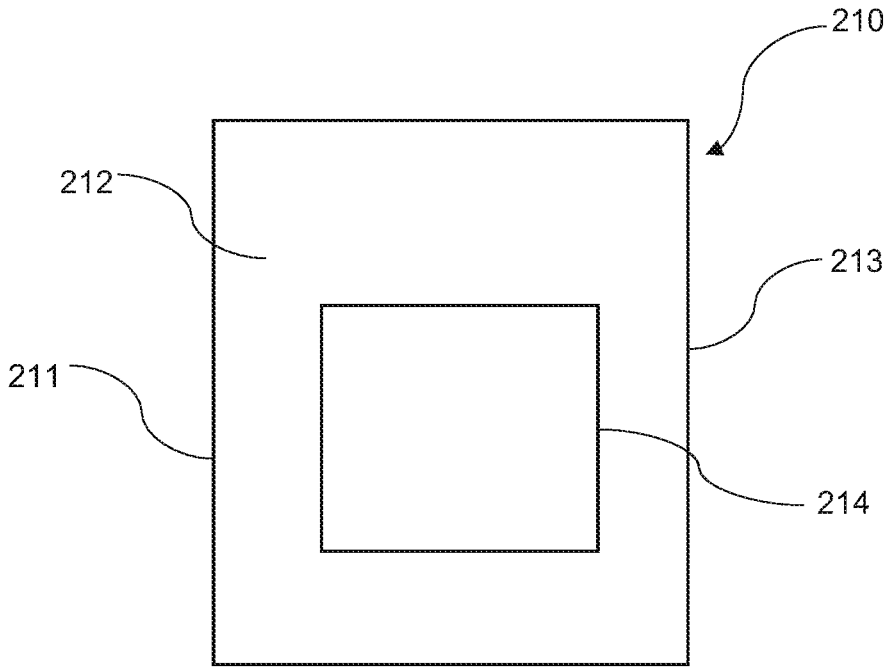
FIG. 2 is a simplified front view of another embodiment of the surface collectible.

FIG. 2 is a simplified front view of another embodiment of a surface collectible 210. In certain embodiments, such as the embodiment illustrated in FIG. 2, the surface collectible 210 can include one or more of a surface collectible outer perimeter 211, the surface member 212, a surface member edge 213, and an image 214. As illustrated in FIG. 2, the surface member edge 213 can form at least a portion of the surface collectible outer perimeter 211. Additionally, or in the alternative, the surface member edge 213 can form the entire surface collectible outer perimeter 211. It is understood that the surface collectible 210 can include fewer or additional components than those specifically illustrated herein.

In certain embodiments, the surface member 212 can have a shape, a size and/or a thickness that varies depending on the design requirements of the surface collectible 210. In the embodiment illustrated in FIG. 2, the surface member 212 has a somewhat rectangular shape. In other embodiments, the surface member 212 can have a somewhat square shape, triangular shape, trapezoidal shape, star shape, circular shape, polygonal shape, or any other suitable geometrical shape, as non-exclusive examples. Alternatively, the surface member 212 can have a random shape that includes curves and/or linear edges. Further, in one embodiment, the surface member 212 can have a width of approximately 5", a length of approximately 7", and the thickness of approximately ¼". Additionally, and/or alternatively, the surface member 212 can be of any other suitable shape, size and/or thickness.

In various embodiments, the image 214 can include a photograph, a graphic, a digital image, artwork, a computer generated image, a hologram, etc. The image 214 can be color and/or black and white. Alternatively, the image 214 can include any other suitable format that allows the image 214 to be imprinted on to the surface member 212. As referred to herein, the term imprinted can include stamping, embedding, adhering, printing, sealing, painting, embossing, imprinting, inscribing, etc.

In some embodiments, the image 214 can depict and/or have a relatively similar appearance to a professional or non-professional individual or team logo or other mark, trademark, or similar indicia (hereinafter sometimes collectively referred to as a "sporting logo") and/or a person such as a professional or non-professional athlete or other athletically-involved persons (hereinafter sometimes collectively referred to as an "athlete"). As used herein, a professional athlete includes any person that is/was employed and/or plays/played for a professional sports team. Further, as used herein, a non-professional athlete can include any person that is/was employed and/or plays/played for a non-professional, semi-professional, collegiate or amateur sports team, public figure, entertainer, celebrity, singer, influencer, actor, etc. Still further, as used herein, "athletically-involved person" includes persons such as players, former players, coaches, managers, owners, etc., or any other person that may be involved or associated with a sport or a sporting team. Alternatively, the image 214 can depict non-sports figures, such as entertainers, actors, historical figures, public figures, or any other suitable person, animal, character, etc.

While the embodiment illustrated in FIG. 2 shows one image 214, it is appreciated that the surface collectible 210 can include any number of images, i.e., a first image, a second image, etc. Additionally, it is further understood that although FIG. 2 illustrates the components of the surface collectible 210 in a particular position, sequence and/or order, these components can be located in any suitably different position, sequence and/or order than that illustrated in FIG. 2.

In certain embodiments, the image 214 can be imprinted on the surface member 212. The image 214 can be imprinted on to the surface member 212 via any suitable manner or method. Additionally, the image 214 can be imprinted on to any portion and/or at any location of the surface member 212.

Figure 3:
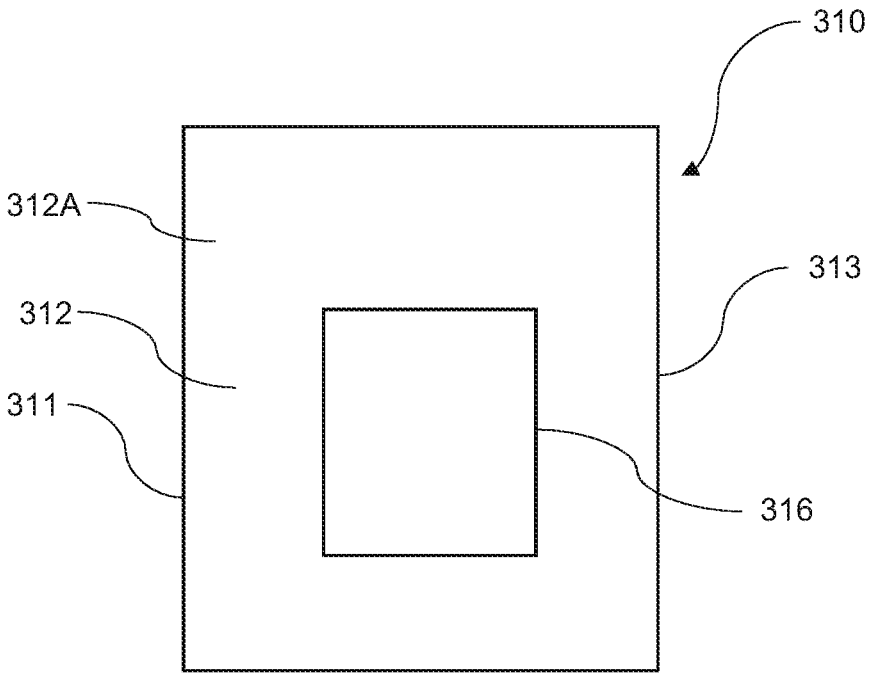
FIG. 3 is a simplified front view of still another embodiment of the surface collectible.

FIG. 3 is a simplified front view of still another embodiment of the surface collectible 310. In the embodiment illustrated in FIG. 3, the surface collectible 310 includes one or more of a surface collectible outer perimeter 311, the surface member 312, a surface member edge 313, and a textile 316. As illustrated in FIG. 3, the surface member edge 313 can form at least a portion of the surface collectible outer perimeter 311. Additionally, or in the alternative, the surface member edge 313 can form the surface collectible outer perimeter 311.

In certain embodiments, the textile 316 can include at least a portion of an article of clothing, which may include a portion of a uniform of an athlete or non-athlete, for example. As one non-exclusive example, the article of clothing can include a portion of a sports uniform, such as a jersey, as one non-exclusive example. As other non-exclusive examples, the article of clothing can include at least a portion of shorts, socks, shoes, pants, shirt, hat, etc., and/or other sports-related or non-sports-related clothing or equipment. Alternatively, the textile 316 can include any other suitable article of clothing or textile used during the course of a sporting event, entertainment or celebrity event, historical event or any other suitable event of significance. In one embodiment, the textile 316 can be event-used. As referred to herein in relation to the textile 316, the term "event-used" means worn, used, or in effect on during a sporting event, entertainment or celebrity event, historical event, or any other suitable event of significance. In certain non-exclusive embodiments, the textile can be a portion of sporting equipment, such as a portion of a ball, a bat, a glove, or any other suitable type of equipment.

While the embodiment illustrated in FIG. 3 shows one textile 316, it is appreciated that the surface collectible 310 can include any number of textiles, i.e., a first textile, a second textile, etc. Additionally, it is further understood that although FIG. 3 illustrates the components of the surface collectible 310 in a particular position, sequence and/or order, these components can be located in any suitably different position, sequence and/or order than that illustrated in FIG. 3.

In some embodiments, the textile 316 can be secured to the surface member 312. As referred to herein, the term secured can include to fasten, attach, embed, implant, insert, etc. The textile 316 can be secured to the surface member 312 via any suitable manner or method. Further, the textile 316 can be secured to any portion and/or at any location of the surface member 312. Additionally, in some embodiments, as shown in FIG. 3, the textile 316 can be secured to and in contact with only a first side 312A, e.g., a front side or top side, of the surface member 312. Moreover, as illustrated, with such design, both the surface member 312 and the textile 316 are visible and/or exposed.

Figure 4:
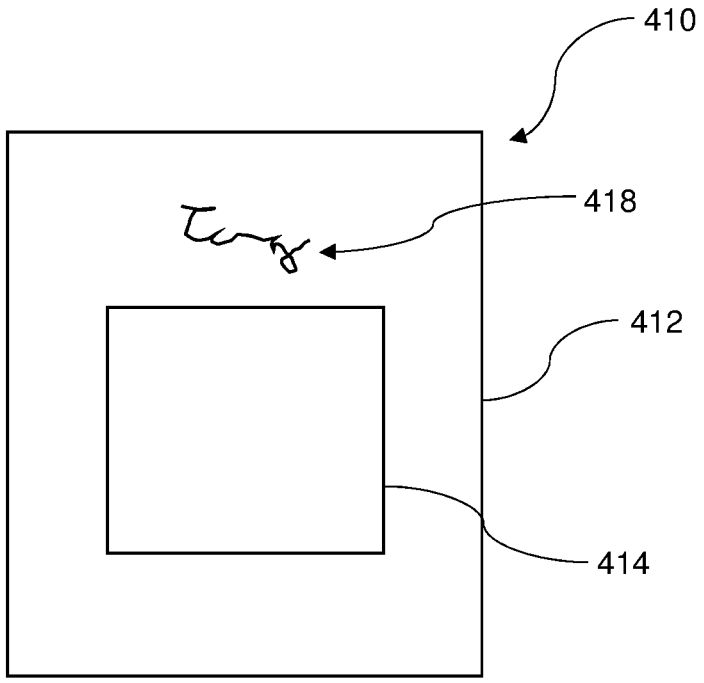
FIG. 4 is a simplified front view of yet another embodiment of the surface collectible.

FIG. 4 is a simplified front view of yet another embodiment of the surface collectible 410. In the embodiment illustrated in FIG. 4, the surface collectible 410 includes one or more of the surface member 412, the image 414 and an autograph 418.

In certain embodiments, the autograph 418 can be positioned directly on the surface member 412. In other words, a person can inscribe his and/or her autograph 418 directly onto the surface member 412. Stated another way, the autograph 418 can include an autograph of a professional athlete, a non-professional athlete and/or an athletically-involved person directly on the surface member 412. Alternatively, the autograph 418 can include an autograph of an entertainer, public figure, celebrity, influencer, singer, actor, historical figure, etc. Still alternatively, the autograph 418 can be positioned directly on the image 414 and/or the textile 316 (illustrated in FIG. 3). In one embodiment, the autograph 418 can be positioned partially on the image 414. Further, the autograph 418 can be inscribed on any portion and/or at any location of the surface member 412. As used herein, the term "autograph" can include an actual or digital or facsimile signature, an inscription and/or an imprint (such as handprints, footprints or prints from any other suitable body part).

Additionally, while the embodiment illustrated in FIG. 4 shows one autograph 418, it is appreciated that the surface collectible 410 can include any number of autographs, i.e., a first autograph, a second autograph, etc. Additionally, it is understood that although FIG. 4 illustrates the components of the surface collectible 410 in a particular position, sequence and/or order, these components can be located in any suitable position, sequence and/or order other than that illustrated in FIG. 4.

Figure 5:
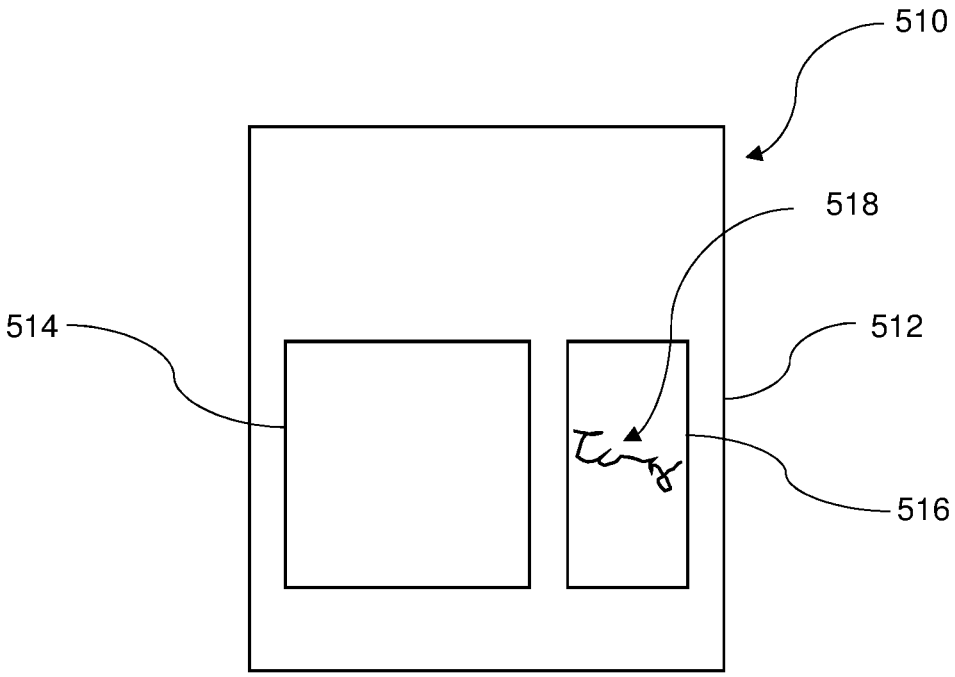
FIG. 5 is a simplified front view of even another embodiment of the surface collectible.

FIG. 5 is a simplified front view of even another embodiment of the surface collectible 510. In the embodiment illustrated in FIG. 5, the surface collectible 510 includes one or more of the surface member 512, the image 514, the textile 516 and the autograph 518. However, in this embodiment, the autograph 518 is positioned on the textile 516.

It is understood that while the embodiment illustrated in FIG. 5 shows one image 514, one textile 516 and one autograph 518, it is appreciated that the surface collectible 510 can include any number of images, textiles and/or autographs. Additionally, it is further understood that although FIG. 5 illustrates the components of the surface collectible 510 in a particular position, sequence and/or order, these components can be located in any suitably different position, sequence and/or order than that illustrated in FIG. 5.

Figure 6:
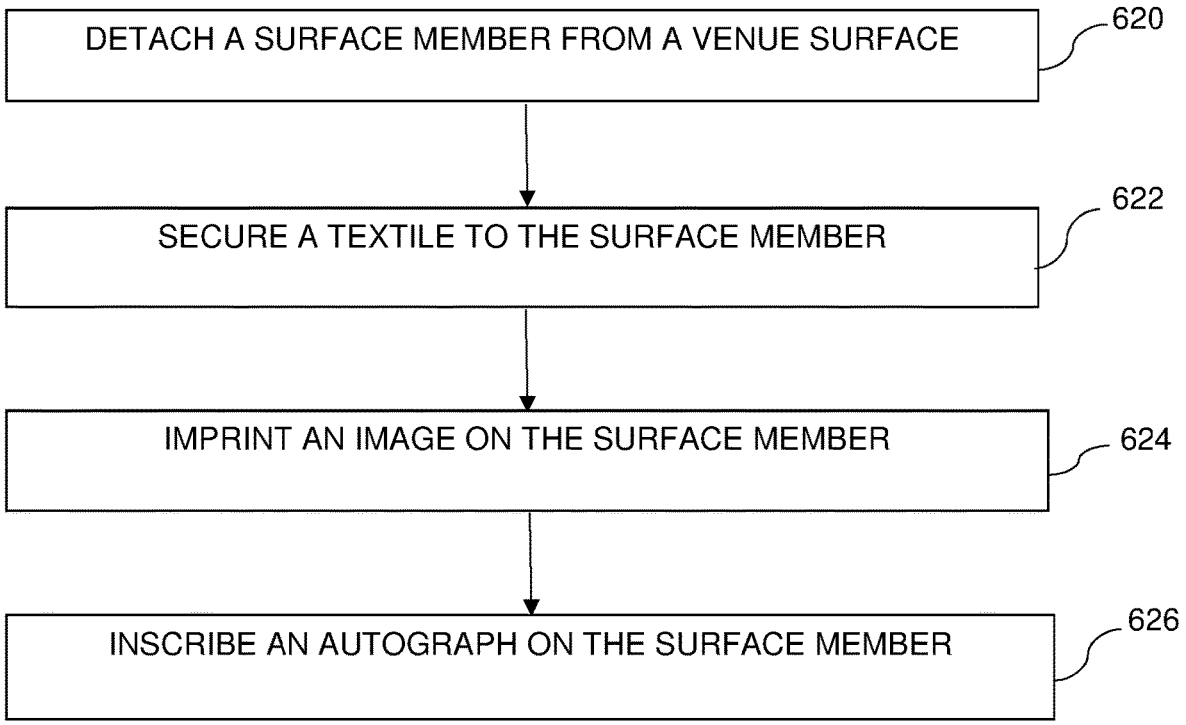
FIG. 6 is a flowchart outlining one embodiment of a method for making a surface collectible.

FIG. 6 is a flowchart illustrating one embodiment of a method for making the surface collectible 610. It is appreciated that the order of the steps illustrated and described in FIG. 6 is not necessarily indicative of how the method of making the surface collectible 610 functions chronologically, as one or more of the steps can be combined, reordered, and/or performed simultaneously without deviating from the intended breadth and scope of the method for making the surface collectible 610. It is understood that one or more steps illustrated in FIG. 6 can be omitted, and/or additional steps can be included which are not necessarily shown or described herein.

At step 620, the surface member is detached from a venue surface, which may include any flooring, court, field, wall, gate, fence and/or other suitable venue surface.

At step 622, the textile is secured to the surface member. In various embodiments, at least a portion of any article of clothing, may be secured to the surface member. The textile may be secured to the surface member via any suitable manner or method. For example, a portion of the textile may be embedded or implanted in the surface member. Alternatively, the textile can be secured to or enclosed in or with the surface member via an adhesive material, plastic or metal fasteners, hook and loop fasteners, or any other suitable manner for attaching the textile to the surface member. In an alternative embodiment, the textile can be secured to the surface member prior to detachment or removal of the surface member from the venue surface.

At step 624, the image can be imprinted on the surface member. In certain embodiments the image may include sporting logos, professional athletes, non-professional athletes, other athletically-involved persons, entertainers, celebrities, influencers, historical figures, public figures, etc. The image can be imprinted onto the surface member via any suitable manner or method. In some embodiments, the image can be imprinted on to the surface member with the use of computers, vinyl cutter plotters, digital plotters, paint or dye sublimation and heat transfer, as certain non-exclusive examples.

At step 626, the autograph can be directly inscribed on the surface member. In various embodiments, the autograph can be witnessed by a representative and authenticated (hereinafter sometimes referred to simply as an "authentic autograph"). Alternatively, the autograph can be a representation of an autograph rather than an original autograph. The autograph can be positioned directly on the textile or the autograph can be positioned directly on the image.

It is understood that although a number of different embodiments of the surface collectible have been illustrated and described herein, one or more features of any one embodiment can be combined with one or more features of one or more of the other embodiments, provided that such combination satisfies the intent of the present invention.

While a number of exemplary aspects and embodiments of the surface collectible have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A surface collectible having a surface collectible outer perimeter, the surface collectible comprising:

a surface member that is detached from a venue surface, the surface member being selected from the group consisting of flooring, walls, ceilings, courts, seats, benches and fields, the surface member having a surface member edge that forms the entirety of the surface collectible outer perimeter; and a textile that is secured to and in contact with the surface member so that at least a portion of the surface member and the textile are exposed.

2. The surface collectible of claim 1 wherein the surface member is event-used.

3. The surface collectible of claim 1 wherein the surface member includes flooring material.

4. The surface collectible of claim 1 wherein the textile includes at least a portion of an article of clothing.

5. The surface collectible of claim 4 wherein the article of clothing includes a portion of a sports uniform.

6. The surface collectible of claim 1 wherein the surface member includes a surface of a sporting venue.

7. The surface collectible of claim 1 further comprising an image imprinted on the surface member.

8. The surface collectible of claim 7 wherein the image includes at least one of a photograph, a graphic, a digital image, artwork, a computer generated image and a hologram.

9. The surface collectible of claim 7 wherein the image includes a logo.

10. The surface collectible of claim 7 wherein the image includes at least one of a professional athlete, a non-professional athlete, an athletically-involved person, an entertainer, an actor, a historical figure and a public figure.

11. The surface collectible of claim 1 further comprising an autograph inscribed on the surface member.

12. The surface collectible of claim 1 further comprising an autograph inscribed on the textile.

* * * * *